US009100751B2

(12) United States Patent
Kim et al.

(10) Patent No.: US 9,100,751 B2
(45) **Date of Patent: *Aug. 4, 2015**

(54) DOCKING STATION HAVING STRUCTURE FOR SOUND AMPLIFICATION AND SOUND QUALITY ENHANCEMENT

(71) Applicant: Samsung Electronics Co. Ltd., Suwon-si, Gyeonggi-do (KR)

(72) Inventors: Jun Tai Kim, Yongin-si (KR); Byoung-Hee Lee, Seoul (KR); Jang Hoon Kang, Bucheon-si (KR); Joon Rae Cho, Seoul (KR); Jung Eun Han, Seoul (KR); Ki Won Kim, Suwon-si (KR); Tae Eon Kim, Seoul (KR); Sun Young Lee, Eumseong-gun (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/925,252

(22) Filed: Jun. 24, 2013

(65) Prior Publication Data

US 2013/0279731 A1 Oct. 24, 2013

Related U.S. Application Data

(63) Continuation of application No. 13/176,177, filed on Jul. 5, 2011, now Pat. No. 8,483,420.

(30) Foreign Application Priority Data

Dec. 7, 2010 (KR) ..... 10-2010-0124523
Feb. 11, 2011 (KR) ..... 10-2011-0012566

(51) Int. Cl.
*H04R 1/20* (2006.01)
*H04R 1/30* (2006.01)
(Continued)

(52) U.S. Cl.
CPC .. *H04R 1/30* (2013.01); *H04R 5/02* (2013.01); *H04R 1/2853* (2013.01); *H04R 1/2861* (2013.01); *H04R 2205/021* (2013.01)

(58) Field of Classification Search
CPC ..... H04R 1/02; H04R 1/30; H04R 1/345; H04R 1/2853; H04R 1/2861; H04R 5/02; H04R 2205/021; G10K 11/02; G10K 11/025
USPC ..... 381/334, 337, 338, 339, 340, 341, 342, 381/386; 379/441, 447, 454, 455; 455/344, 455/350, 351, 575.1, 90.1
See application file for complete search history.

(56) References Cited

U.S. PATENT DOCUMENTS 3,249,873 A 5/1966 Whittemore, Jr. et al.
3,748,583 A * 7/1973 Andersen et al. ..... 455/348
(Continued)

FOREIGN PATENT DOCUMENTS

EP 1 585 108 A2 10/2005
EP 1 655 929 A1 5/2006
(Continued)

*Primary Examiner* — Huyen D Le
(74) *Attorney, Agent, or Firm* — Jefferson IP Law, LLP

(57) ABSTRACT

A docking station for sound amplification and sound quality enhancement is provided. The docking station includes a support structure for holding a mobile terminal having an internal speaker to sustain the posture of the mobile terminal, and a body for supporting the support structure, and for physically contacting the speaker to increase the volume of sound output from the speaker. The body includes a collecting hole for contacting the speaker to collect sound waves, and a guide hole that extends from the collecting hole through the body to the outside along an extension direction, is divided into two branches within the body to guide the collected sound waves along different paths, and has a horn shape whose cross section increases along the extension direction. Hence, the docking station can increase the volume of audible sound and sound quality without separate supply of power.

13 Claims, 21 Drawing Sheets

(51) Int. Cl.
*H04R 5/02* (2006.01)
*H04R 1/28* (2006.01)

(56) References Cited

U.S. PATENT DOCUMENTS 5,832,079 A * 11/1998 Rabe ..... 379/433.13
5,970,158 A 10/1999 Beltran
7,689,197 B2 3/2010 Laude et al.
8,320,597 B2 11/2012 Griffin, Jr. et al.
8,483,420 B2 * 7/2013 Kim et al. ..... 381/337
2005/0205348 A1 9/2005 Parker et al.
2006/0084468 A1 4/2006 Kim
2008/0138028 A1 6/2008 Grady et al.
2010/0183170 A1 7/2010 Shen et al.
2010/0183179 A1 7/2010 Griffin, Jr. et al.
2011/0043984 A1 2/2011 Byrne

FOREIGN PATENT DOCUMENTS

KR 10-2009-0097619 A 9/2009
WO 2009/134455 A1 11/2009

* cited by examiner

<a> <b>

<a> <b>

<a> <b>

DOCKING STATION HAVING STRUCTURE FOR SOUND AMPLIFICATION AND SOUND QUALITY ENHANCEMENT

PRIORITY

This application is a continuation of U.S. patent application Ser. No. 13/176,177, filed on Jul. 5, 2011, which claims the benefit under 35 U.S.C. §119(a) of a Korean patent application filed on Dec. 7, 2010 in the Korean Intellectual Property Office and assigned Serial No. 10-2010-0124523 and a Korean patent application filed on Feb. 11, 2011 in the Korean Intellectual Property Office and assigned Serial No. 10-2011-0012566, the entire disclosure of which is hereby incorporated by reference.

BACKGROUND OF THE INVENTION

1. Field of the Invention

The present invention relates to a docking station for a mobile terminal. More particularly, the present invention relates to a docking station having a structure for sound amplification and sound quality enhancement.

2. Description of the Related Art

Unlike a desktop computer, a mobile terminal of the related art, such as a laptop computer or a handheld computer, does not have an interface connectable to external devices, such as local printers, backup drives and mass storage devices. Therefore, a docking station is proposed to provide additional interfaces to such a mobile terminal. The docking station provides an interface connecting the mobile terminal with an external device. The docking station may have a speaker. That is, the docking station may amplify an audio signal from the mobile terminal to produce sound through the speaker.

However, the docking station requires electric power to operate the speaker. That is, the docking station may have to be connected to an external power source to produce loud sounds through the speaker. In other words, it is difficult for the docking station to increase sound volume without additional supply of power. Hence, usefulness of the docking station may be degraded.

Therefore, a need exists for a docking station that is structured to increase sound volume and improve sound quality for higher utilization without being electrically connected to a mobile terminal or an external power source.

SUMMARY OF THE INVENTION

An aspect of the present invention is to address at least the above problems and/or disadvantages and to provide at least the advantages described below. Accordingly, an aspect of the present invention provides a docking station that is structured to increase sound volume and improve sound quality for higher utilization without being electrically connected to a mobile terminal or an external power source.

In accordance with an aspect of the present invention, a docking station is provided. The docking station includes a support structure for holding a mobile terminal having an internal speaker to sustain the posture of the mobile terminal, and a body for supporting the support structure, and for physically contacting the speaker of the mobile terminal placed on the support structure to increase the volume of sound output from the speaker. The body includes a collecting hole for contacting the speaker to collect sound waves, and a guide hole that extends from the collecting hole through the inside of the body to the outside along an extension direction, is divided into two branches within the inside of the body to guide the collected sound waves along different paths, and has a horn shape whose cross section increases along the extension direction.

In an exemplary implementation, the docking station increases the volume of audio sounds coming from the mobile terminal through a guide hole. The docking station does not have to be electrically connected to the mobile terminal and does not have to be connected to an external power source. That is, the docking station is capable of increasing the volume of audio sounds without separate supply of power. In addition, the docking station guides sound waves along multiple paths through the guide hole and hence may maintain sound balance. The docking station can maintain an increase in sound volume within a given range along frequencies within the range of hearing, heightening sound quality. As a result, the docking station may output sounds pleasant to the user, and the usefulness of the docking station is increased.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

FIGS. 1 through 19, discussed below, and the various exemplary embodiments used to describe the principles of the present disclosure in this patent document are by way of illustration only and should not be construed in any way that would limit the scope of the disclosure. Those skilled in the art will understand that the principles of the present disclosure may be implemented in any suitably arranged communications system. The terms used to describe various embodiments are exemplary. It should be understood that these are provided to merely aid the understanding of the description, and that their use and definitions in no way limit the scope of the invention. Terms first, second, and the like are used to differentiate between objects having the same terminology and are in no way intended to represent a chronological order, unless where explicitly state otherwise. A set is defined as a non-empty set including at least one element.

Figure 1:
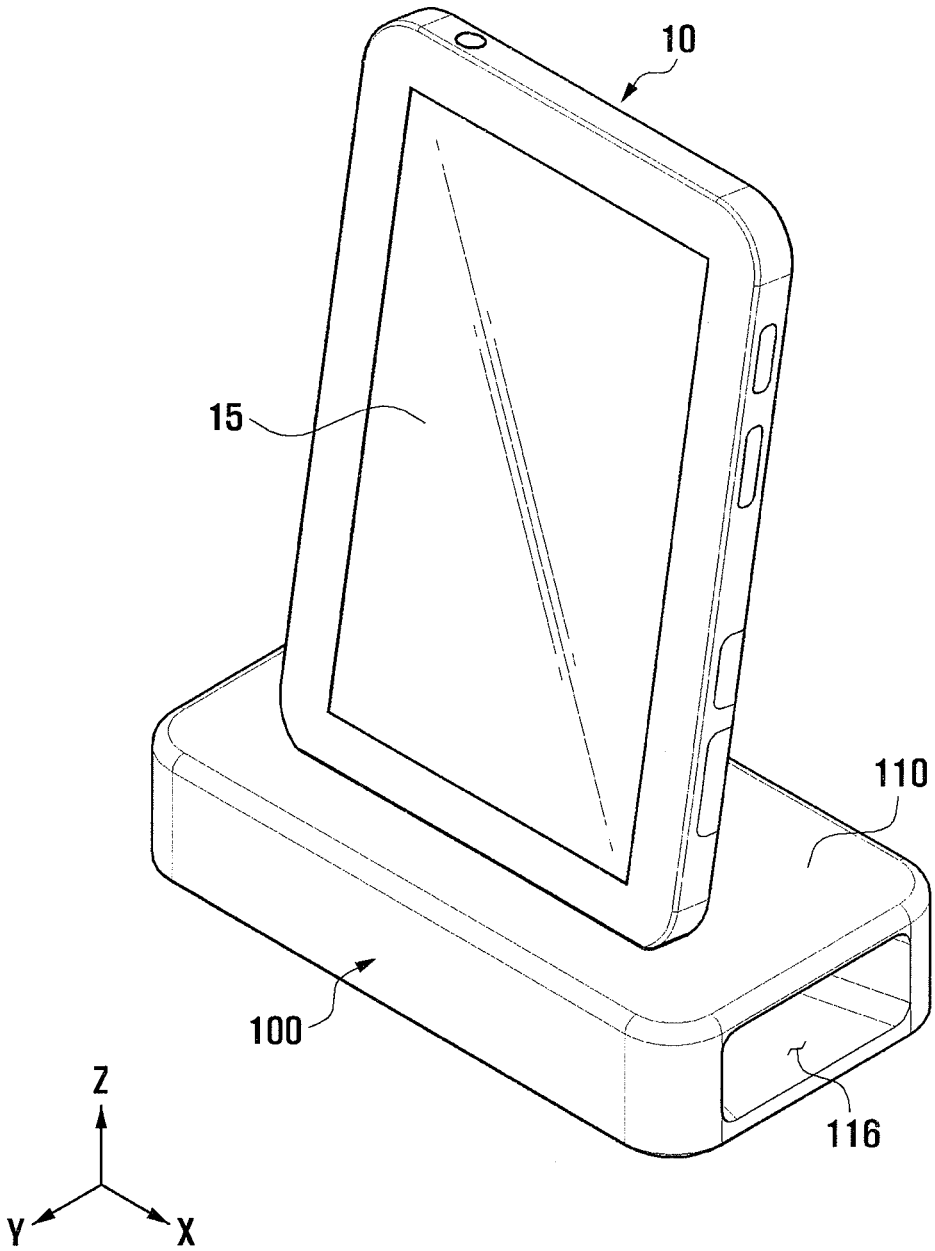
FIG. 1 is a top perspective view of a docking station according to an exemplary embodiment of the present invention.
Figure 2:
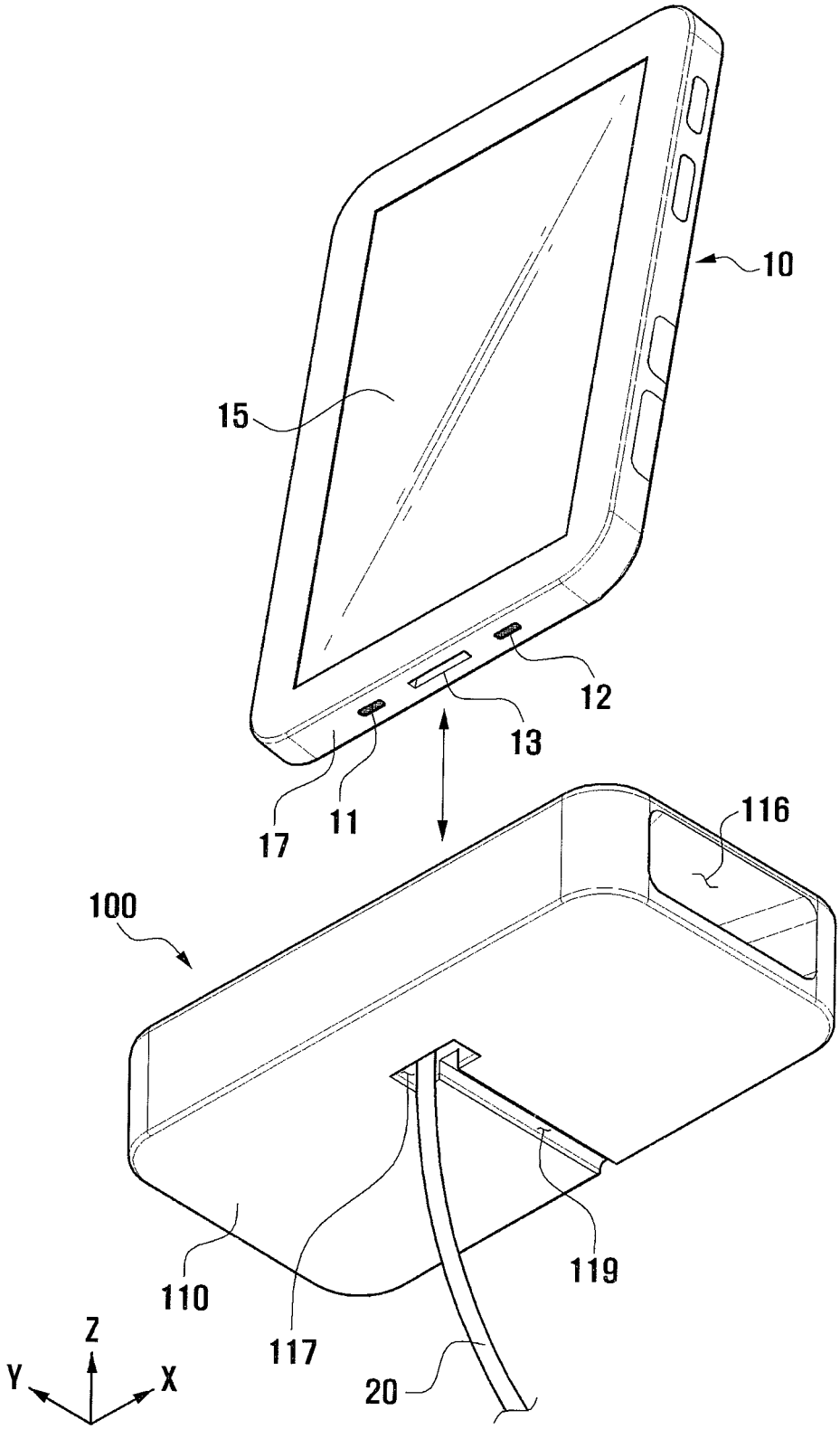
FIG. 2 is a bottom perspective view of a docking station according to an exemplary embodiment of the present invention.
Figure 3:
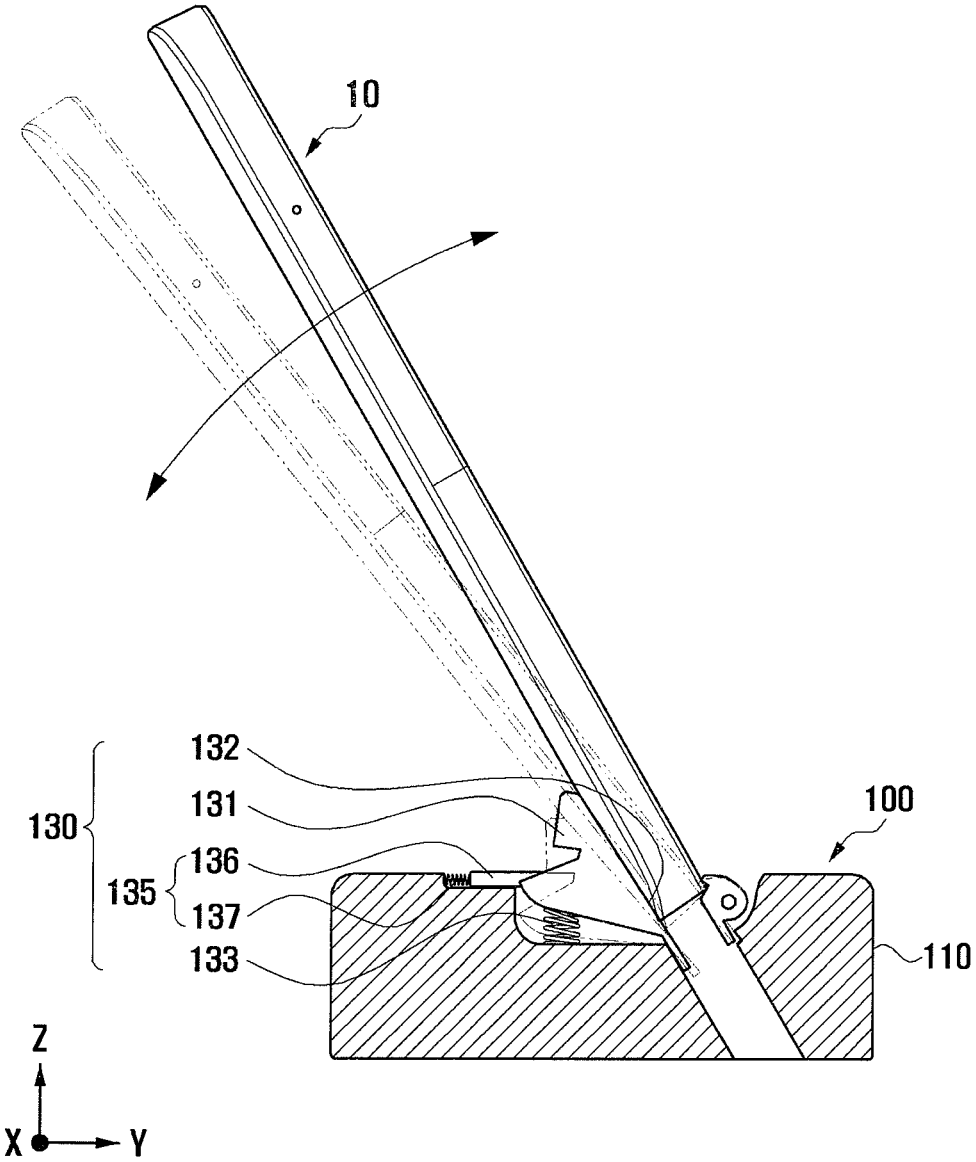
FIG. 3 is a side sectional view of a docking station according to an exemplary embodiment of the present invention.
Figure 4:
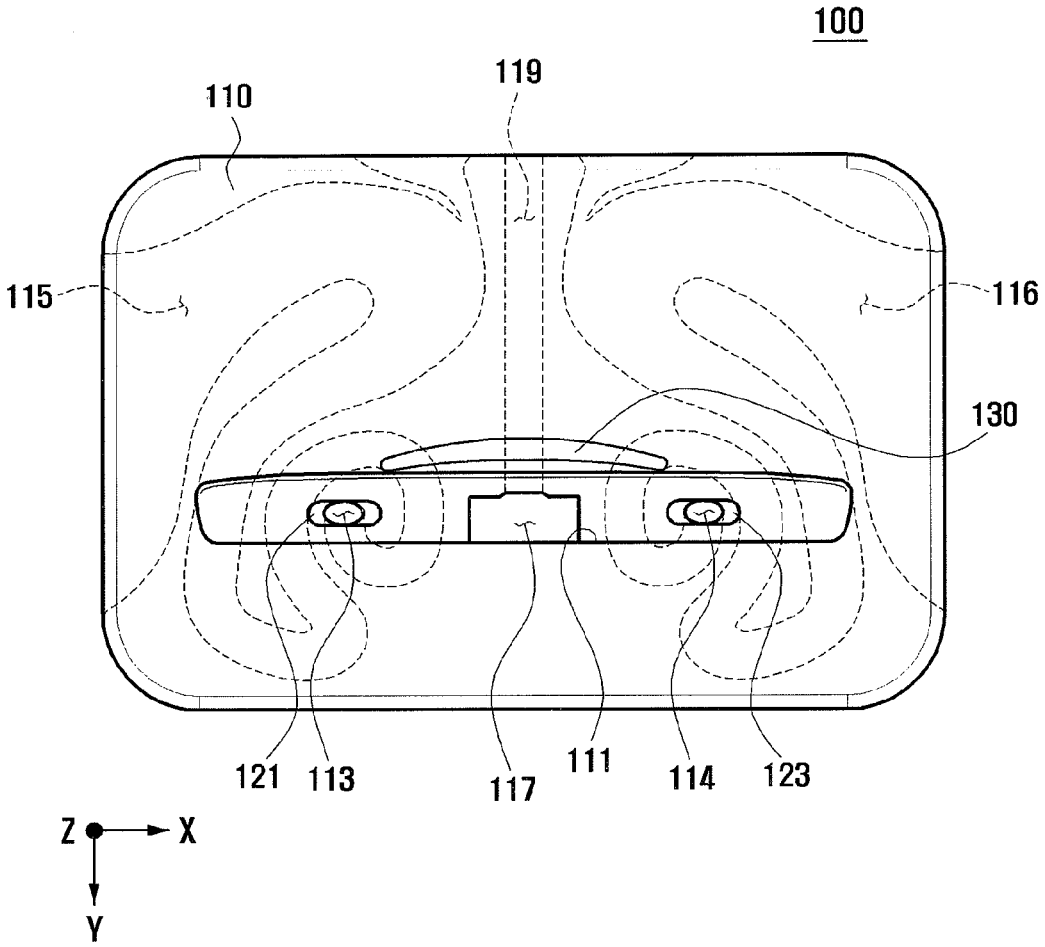
FIG. 4 is a transparent top view of a docking station according to an exemplary embodiment of the present invention.

FIGS. 1 through 4 illustrate a docking station according to exemplary embodiments of the present invention. More particularly, FIG. 1 is a top perspective view of a docking station, FIG. 2 is a bottom perspective view of a docking station, FIG. 3 is a side sectional view of a docking station, and FIG. 4 is a transparent top view of a docking station.

Referring to FIGS. 1 through 4, a docking station 100 is configured to be capable of being physically coupled to a mobile terminal 10. Here, the mobile terminal 10 includes two speakers 11 and 12, a connecting socket 13, and a display unit 15. The speakers 11 and 12 are separated by a given distance in the bottom side 17 of the mobile terminal 10, and the connecting socket 13 is placed between the speakers 11 and 12 in the bottom side 17. In the mobile terminal 10, the display unit 15 is placed to be perpendicular to the bottom side 17. In the docking station 100, the front is arranged to face in the same direction as the display unit 15 of the mobile terminal 10, the rear is arranged to face a direction opposite to the front, and the sides are arranged to connect the front and the rear. The docking station 100 includes a body 110, contact pads 121 and 123, and a support structure 130.

The body 110 of the docking station 100 provides a supplementary function to the mobile terminal 10. The body 110 has a preset shape and size. For example, the body 110 may take the form of a hexahedron having a fixed area, thickness and rounded edges. The body 110 may be made of plastic. The body 110 is configured to include a seating groove 111, two collecting holes 113 and 114, two guide holes 115 and 116, a connection hole 117, and a connection groove 119.

The seating groove 111 is formed so as to extend from the upper surface of the body 110 to the inside thereof and has a given depth. To accommodate the bottom side 17 of the mobile terminal 10, the seating groove 111 is formed to be wider than the bottom side 17.

Each of the collecting holes 113 and 114 extends from the upper surface of the body 110 to the inside thereof. On the upper surface of the body 110, the collecting holes 113 and 114 are separated by a distance equal to the distance between the speakers 11 and 12. The collecting holes 113 and 114 are formed within the seating groove 111. When the bottom side 17 of the mobile terminal 10 is seated on the upper surface of the body 110, the collecting holes 113 and 114 physically contact the speakers 11 and 12, respectively. When the mobile terminal 10 outputs audible sound through the speakers 11 and 12, the collecting holes 113 and 114 collect the audible sound from the speakers 11 and 12.

The guide holes 115 and 116 extend from the collecting holes 113 and 114, respectively, through the inside of the body 110 to the outside along extension directions. The guide holes 115 and 116 have a symmetrical structure. That is, the guide holes 115 and 116 extend to the same length. The guide holes 115 and 116 are separately formed in two portions of the body 110. The guide holes 115 and 116 are filled with air. When the collecting holes 113 and 114 collect audible sound from the speakers 11 and 12, the guide holes 115 and 116 guide the audible sound from the collecting holes 113 and 114 to the outside. That is, sound is propagated through vibration of air in the guide holes 115 and 116.

Each of the guide holes 115 and 116 is formed to have a curved cross section perpendicular to the extension direction. That is, the cross section of the guide holes 115 and 116 has a curved circumference like a circle or an ellipse. Hence, the guide holes 115 and 116 may smoothly guide sound from the collecting holes 113 and 114 to the outside along the extension directions in a vortex-free manner. Each of the guide holes 115 and 116 is formed to have a horn shape whose cross section increases along the extension direction. Hence, as the guide holes 115 and 116 guide sound waves from the collecting holes 113 and 114 to the outside, the volume of the sound gradually increases along the extension direction.

Each of the guide holes 115 and 116 is divided into two branches within the inside of the body 110. In other words, when the guide holes 115 and 116 guide sound waves from the collecting holes 113 and 114 to the outside, each outputs sound through two paths leading to the side surface and the rear surface, respectively, of the body 110. Hence, the guide holes 115 and 116 help to maintain sound balance. That is, in the guide holes 115 and 116, the amount of increase in sound volume is uniformly maintained within a given range along frequencies within the range of hearing.

The connection hole 117 extends to penetrate the body 110 from the upper surface to the lower surface. In the body 110, the connection hole 117 is extended between the collecting holes 113 and 114 and between the guide holes 115 and 116, and is separated from the collecting holes 113 and 114 and the guide holes 115 and 116. The connection hole 117 is separated by a given distance from the collecting holes 113 and 114 on the upper surface of the body 110, and the distance from the connection hole 117 to the collecting holes 113 and 114 is equal to the distance from the connecting socket 13 to the speakers 11 and 12. The connection hole 117 is formed within the seating groove 111. Hence, when the bottom side 17 of the mobile terminal 10 is placed on the upper surface of the body 110, the connection hole 117 contacts the connecting socket 13. When a cable 20 connected to an external device (not shown) is inserted from the lower surface of the body 110, the connection hole 117 supports connection between the connecting socket 13 and the cable 20. Here, the external device may correspond to an external power source charging the mobile terminal 10 or to a wired communication device communicating with the mobile terminal 10.

The connection groove 119 extends from the lower surface of the body 110 to the inside thereof, and is formed to run through the lower surface of the body 110 to a given depth. The connection groove 119 extends from the connection hole 117 to one side of the body 110. To accommodate the cable 20, the connection groove 119 is formed to be thicker than the cable 20.

The contact pads 121 and 123 support the function of the body 110 of the docking station 100. The contact pads 121 and 123 are installed around the collecting holes 113 and 114, respectively, on the upper surface of the body 110. That is, the contact pads 121 and 123 expose the collecting holes 113 and 114, respectively. When the bottom side 17 of the mobile terminal 10 is placed on the upper surface of the body 110, the contact pads 121 and 123 are sandwiched between the bottom side 17 of the mobile terminal 10 and the zones around the collecting holes 113 and 114. At this time, the contact pads 121 and 123 expose the speakers 11 and 12 of the mobile terminal 10, respectively. When the bottom side 17 of the mobile terminal 10 is placed on the upper surface of the body 110, the contact pads 121 and 123 bring the speakers 11 and 12 of the mobile terminal 10 into contact with the collecting holes 113 and 114, respectively. Hence, when the mobile terminal 10 outputs sound through the speakers 11 and 12, the contact pads 121 and 123 prevent sound leakage from the collecting holes 113 and 114, respectively. The contact pads 121 and 123 may be made of rubber, silicone or a synthetic polymer, to bring the zones around the speakers 11 and 12 of the mobile terminal 10 into contact with the body 110 of the docking station 100.

The support structure 130 of the docking station 100 holds the mobile terminal 10 and is mounted on the upper surface of the body 110. When the bottom side 17 of the mobile terminal 10 is placed on the upper surface of the body 110, the support structure 130 is physically coupled to the mobile terminal 10 to thereby sustain the posture of the mobile terminal 10. The support structure 130 includes a rotating part 131, a rotation spring 133 and a fixing part 135.

The rotating part 131 is rotatably coupled to the body 110 on the upper surface of the body 110. The rotating part 131 is configured to have a receiving hole 132. The receiving hole 132 exposes the seating groove 111 and the collecting holes 113 and 114 of the body 110 to the outside. To accommodate the bottom side 17 of the mobile terminal 10, the receiving hole 132 is formed to be wider than the bottom side 17. Hence, the mobile terminal 10 may pass through the receiving hole 132 of the rotating part 131 and be seated on the seating groove 111 of the body 110. The rotating part 131 may be rotated together with the mobile terminal 10 and change the posture of the mobile terminal 10. That is, the angle between the upper surface of the body 110 and the mobile terminal 10 may be changed by the rotating part 131.

The rotation spring 133 applies a rotational force to the rotating part 131 using unique elasticity. The rotation spring 133 links a portion of the rotating part 131 with the upper surface of the body 110. The rotation spring 133 applies a rotational force to the rotating part 131 between the rotating part 131 and the body 110 so that the rotating part 131 rotates relative to the upper surface of the body 110.

The fixing part 135 stops rotation of the rotating part 131 on the upper surface of the body 110. The fixing part 135 is coupled to the upper surface of the body 110 so as to protrude from the body 110. The fixing part 135 includes a locking element 136 and a protrusion spring 137. The locking element 136 protrudes from the body 110. One end of the locking element 136 contacts the rotating part 131 to block rotation of the rotating part 131. The protrusion spring 137 applies a protruding force to the locking element 136 using unique elasticity. The protrusion spring 137 connects the other end of the locking element 136 with the upper surface of the body 110. The protrusion spring 137 applies a protruding force to the locking element 136 between the body 110 and the locking element 136 so that the locking element 136 may be protruded from the upper surface of the body 110.

Accordingly, the docking station 100 may provide improved operating characteristics, as will be described in connection with FIGS. 5 and 6.

Figure 5A:
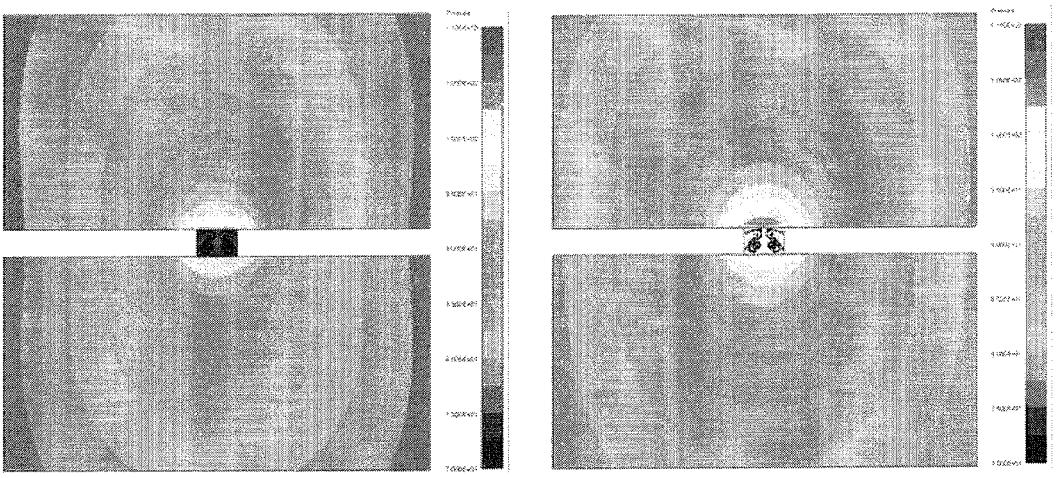
FIGS. 5A through 5C illustrate distribution of sound pressure levels at given frequencies in a docking station according to exemplary embodiments of the present invention.
Figure 5B:
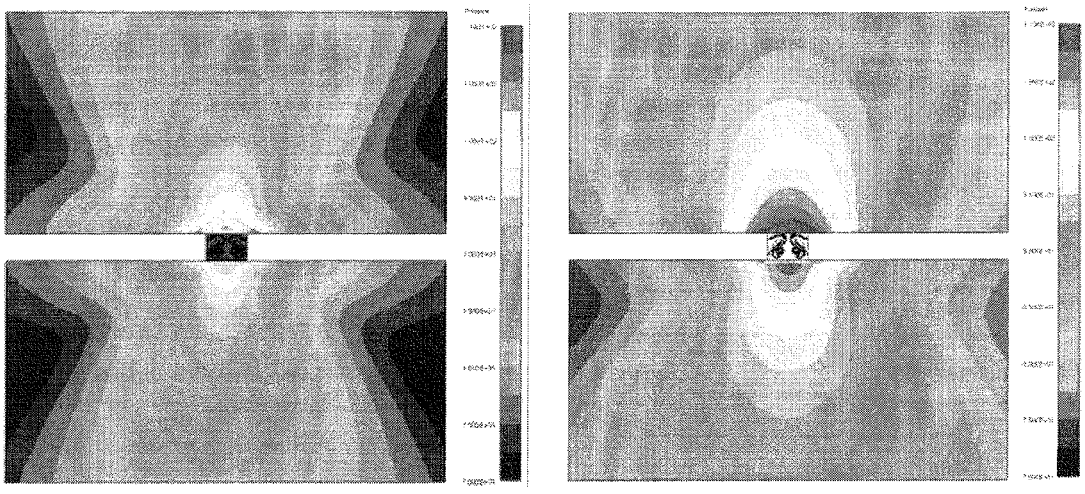
Figure 5C:
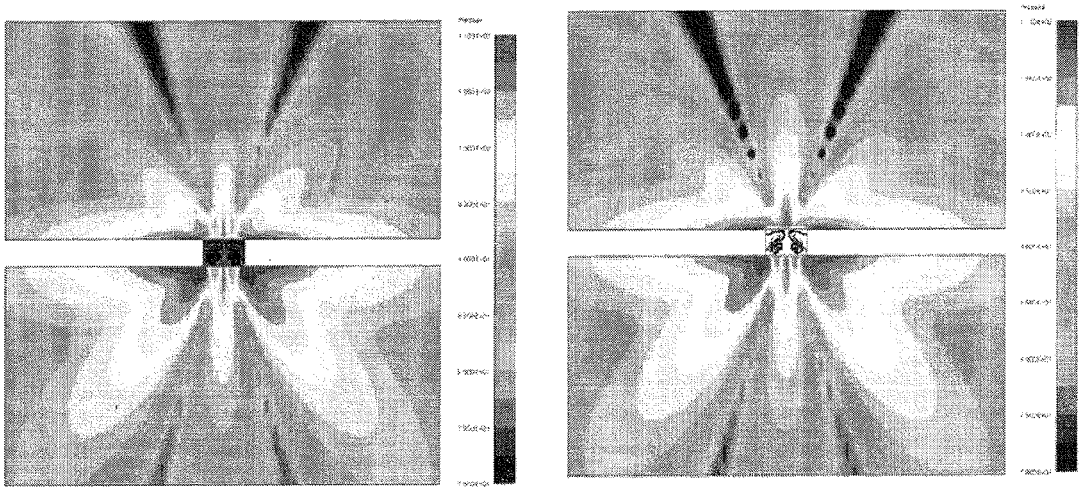

FIGS. 5A through 5C illustrate distribution of sound pressure levels at given frequencies in a docking station according to exemplary embodiments of the present invention. More particularly, FIG. 5A illustrates distribution of sound pressure levels at 630 Hz, FIG. 5B illustrates distribution of sound pressure levels at 1000 Hz, and FIG. 5C illustrates distribution of sound pressure levels at 3150 Hz. Reference symbol <a> indicates a case where the guide hole is not divided into two parts, and reference symbol <b> indicates a case where the guide hole is divided into two parts as described before.

Referring to FIGS. 5A through 5C, when a mobile terminal outputs an audible sound, as each of the guide holes 115 and 116 is divided into two parts, the sound pressure is more widely distributed in the docking station 100. That is, the docking station 100 exhibits omnidirectionality and produces sounds with similar sensitivity in all directions. In other words, the amount of increase in sound volume relative to frequencies is kept uniform in the docking station 100, and hence sound balance is sustained.

Figure 6:
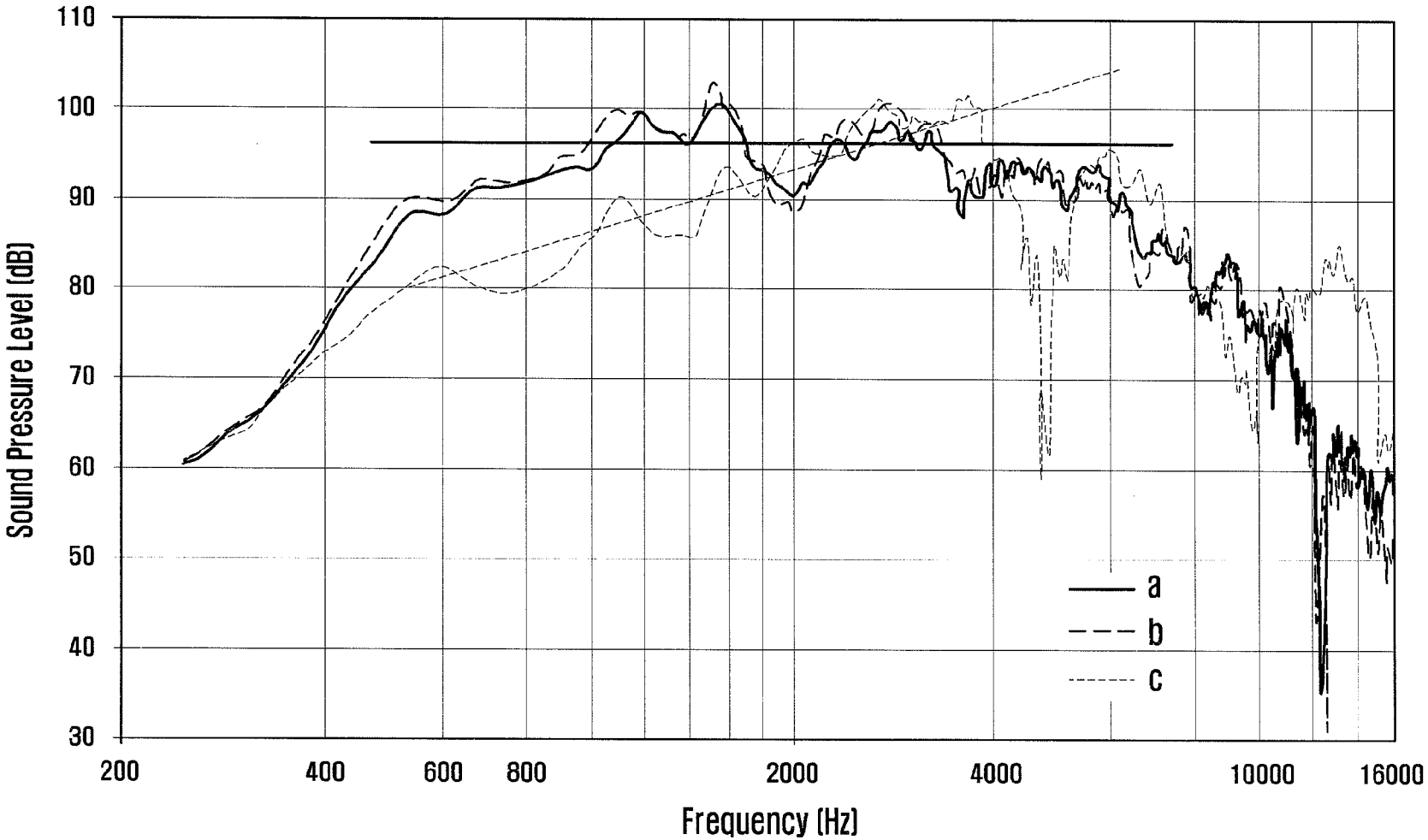
FIG. 6 is a chart illustrating distribution of sound pressure levels with respect to frequency in a docking station according to an exemplary embodiment of the present invention.
Figure 7:
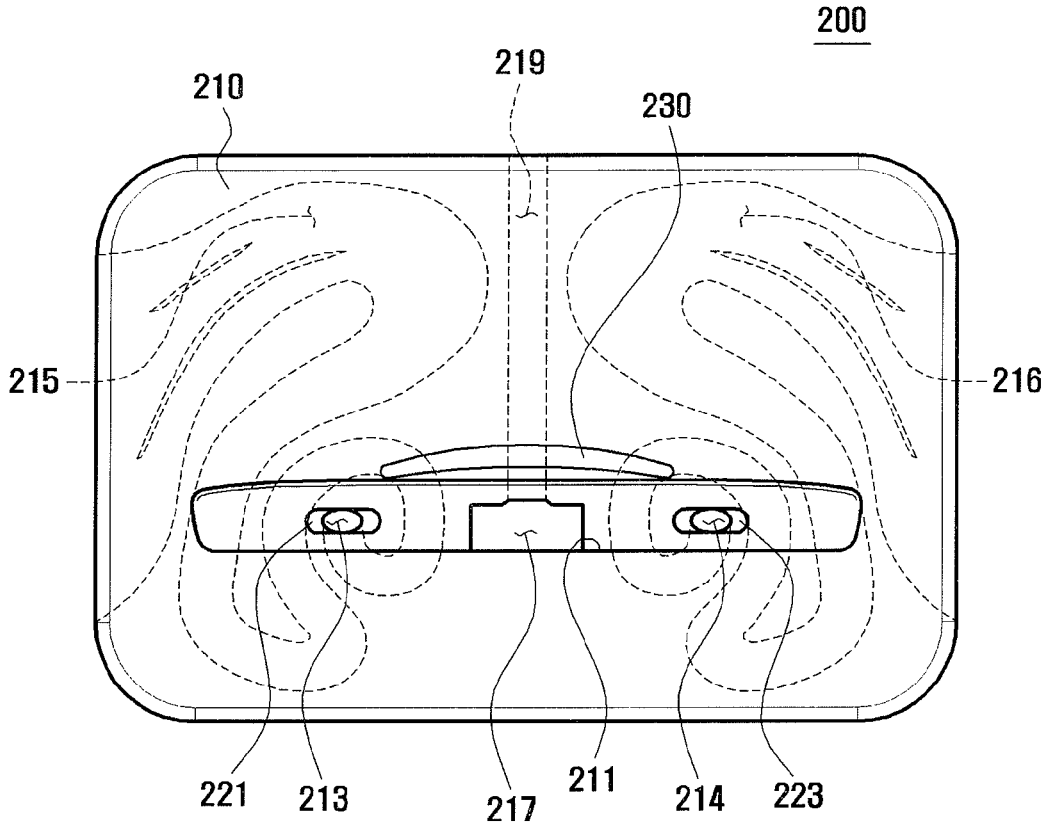
FIGS. 7 through 11 are transparent top views of docking stations according to exemplary embodiments of the present invention.
Figure 8:
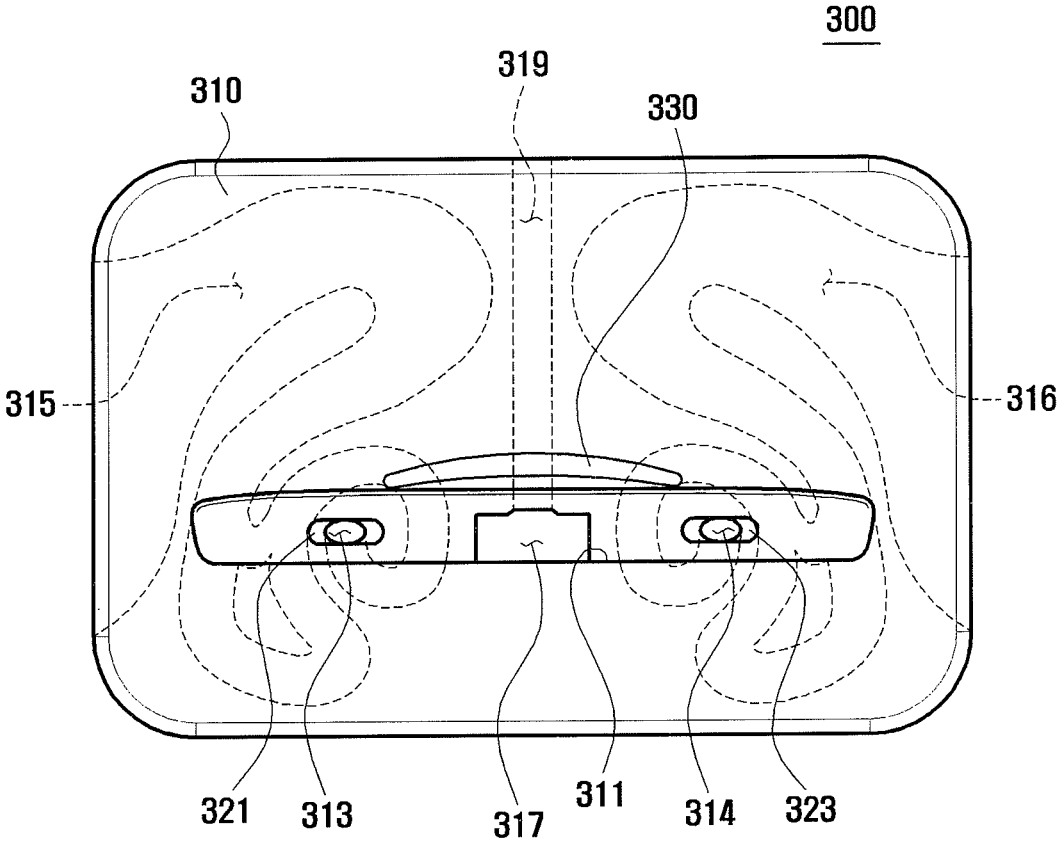
Figure 9:
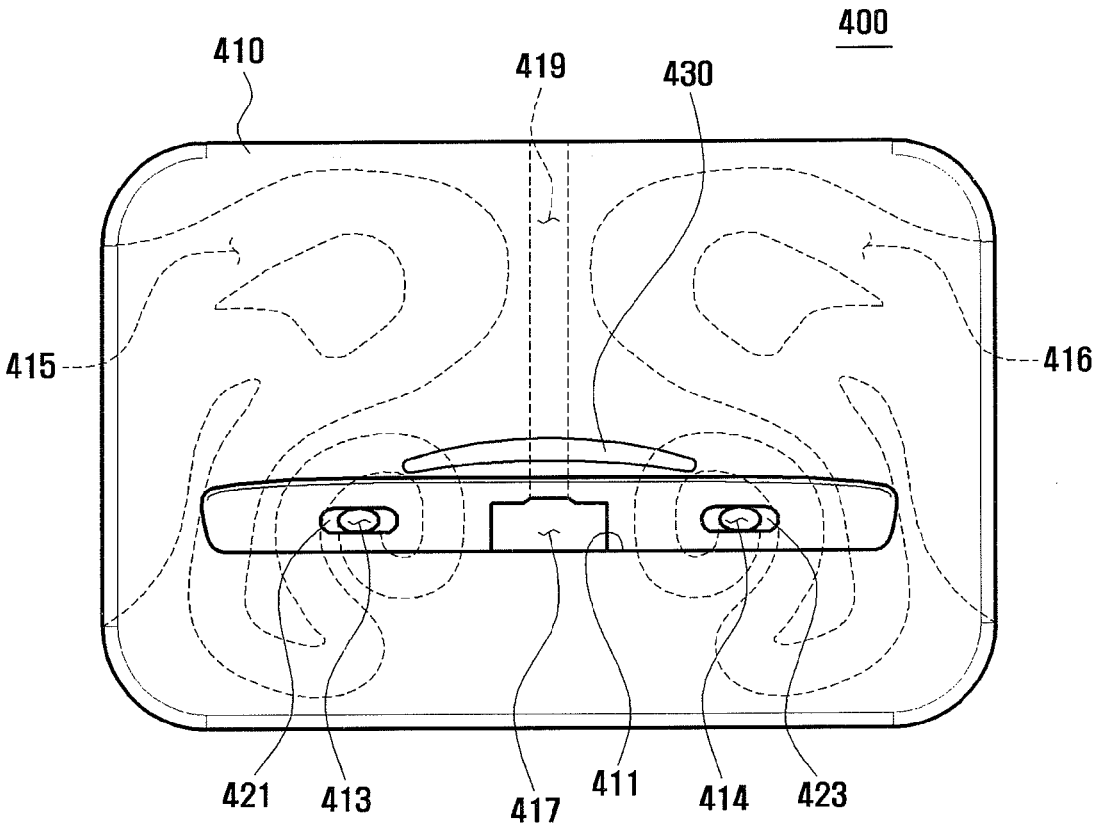
Figure 10:
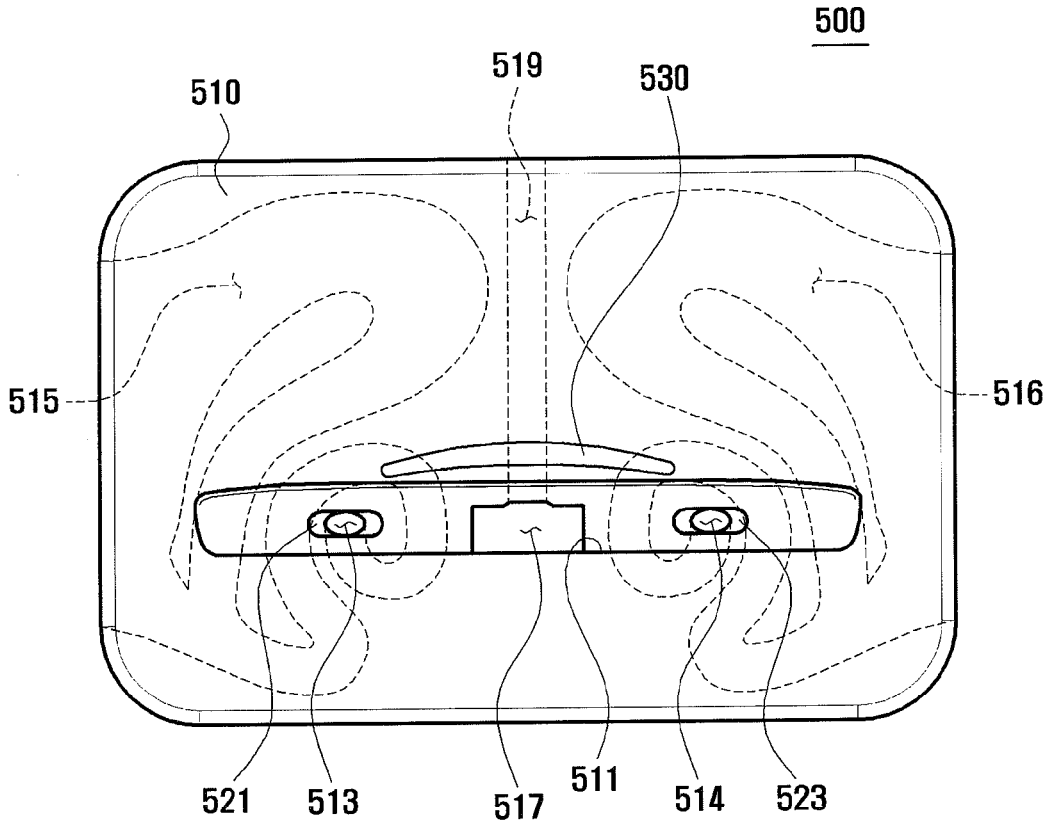
Figure 11:
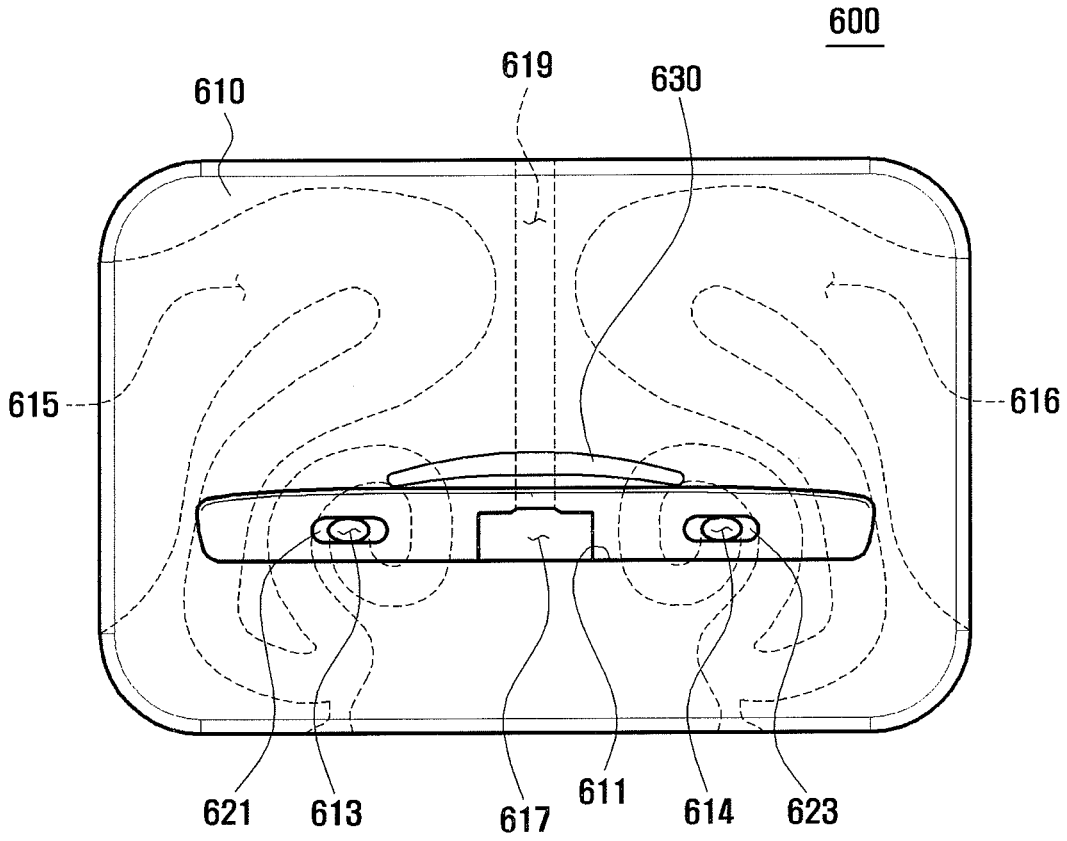

FIG. 6 is a chart illustrating distribution of sound pressure levels with respect to frequency in a docking station according to an exemplary embodiment of the present invention. Reference symbol <a> indicates a case where a docking station has two guide holes each of which is divided into two parts as described before, reference symbol <b> indicates a case where a docking station has two guide holes not divided into two parts, and reference symbol <c> indicates a case where the docking station has one guide hole not divided into two parts.

Referring to FIG. 6, as reference symbol <a> indicates, when a mobile terminal outputs audible sound to the docking station 100 having two bisected guide holes 115 and 116, the amount of change in sound pressure at peaks (reversal from increment to decrement) and dips (reversal from decrement to increment) is small. In addition, the docking station 100 having two guide holes 115 and 116 may maintain the sound pressure within a given range throughout a relatively wide range of frequencies. Hence, the amount of increase in sound volume relative to a wide range of frequencies is kept uniform in the docking station 100, and hence sound balance is sustained. Furthermore, the docking station 100 produces a stereo effect using the two guide holes 115 and 116.

In the above-described exemplary embodiment, each guide hole guides sound waves toward one side and the rear of the body. However, exemplary embodiments of the present invention are not limited thereto. Other exemplary embodiments are described in connection with FIGS. 7 through 11.

FIGS. 7 through 11 are transparent top views of docking stations according to exemplary embodiments of the present invention. In the following docking stations, guide holes have a similar structure as in the above-described embodiment.

Referring to FIGS. 7 through 11, a docking station 200 includes a body 210, contact pads 221 and 223, and a support structure 230. A docking station 300 of FIG. 8 includes a body 310, contact pads 321 and 323, and a support structure 330. A docking station 400 of FIG. 9 includes a body 410, contact pads 421 and 423, and a support structure 430. A docking station 500 of FIG. 10 includes a body 510, contact pads 521 and 523, and a support structure 530. A docking station 600 of FIG. 11 includes a body 610, contact pads 621 and 623, and a support structure 630. The body 210 is configured to include a seating groove 211, two collecting holes 213 and 214, two guide holes 215 and 216, a connection hole 217, and a connection groove 219. The body 310 is configured to include a seating groove 311, two collecting holes 313 and 314, two guide holes 315 and 316, a connection hole 317, and a connection groove 319. The body 410 is configured to include a seating groove 411, two collecting holes 413 and 414, two guide holes 415 and 416, a connection hole 417, and a connection groove 419. The body 510 is configured to include a seating groove 511, two collecting holes 513 and 514, two guide holes 515 and 516, a connection hole 517, and a connection groove 519. The body 610 is configured to include a seating groove 611, two collecting holes 613 and 614, two guide holes 615 and 616, a connection hole 617, and a connection groove 619. Basically, each of the docking stations 200, 300, 400, 500 and 600 has a configuration similar to that of the docking station 100, and a detailed description thereof is omitted.

In each of the docking stations 200, 300, 400, 500 and 600, the guide holes extend from the corresponding collecting holes through the inside of the body to the outside along extension directions, respectively, the guide holes have a symmetrical structure (that is, the guide holes extend to have the same length), and the guide holes are separately formed in two portions of the body.

In each of the docking stations 200, 300, 400, 500 and 600, the guide holes are formed to have a curved cross section perpendicular to the extension directions (that is, the cross section of the guide holes has a curved circumference like a circle or an ellipse), each of the guide holes is formed to have a horn shape whose cross section increases along the extension direction. Hence, in each of the docking stations 200, 300, 400, 500 and 600, as the guide holes guide sound waves from the collecting holes to the outside, the volume of the sound gradually increases along the extension direction.

In each of the docking stations 200, 300, 400, 500 and 600, each of the guide holes is divided into two parts within the inside of the body. In other words, when the guide holes guide sound waves from the corresponding collecting holes to the outside, each outputs sound along at least two paths. Here, sounds may be guided to the side surface of the body or to the side and rear surfaces of the body and are output. In each of the docking stations 200, 300, 400, 500 and 600, the paths in each guide hole may be separated by a wall formed within the guide hole, and the paths in each guide hole may be divided into two branches or combined into one within the inside of the body.

The docking stations 100, 200, 300, 400, 500 and 600 have similar operating characteristics. This is described below in connection with FIG. 12.

Figure 12:
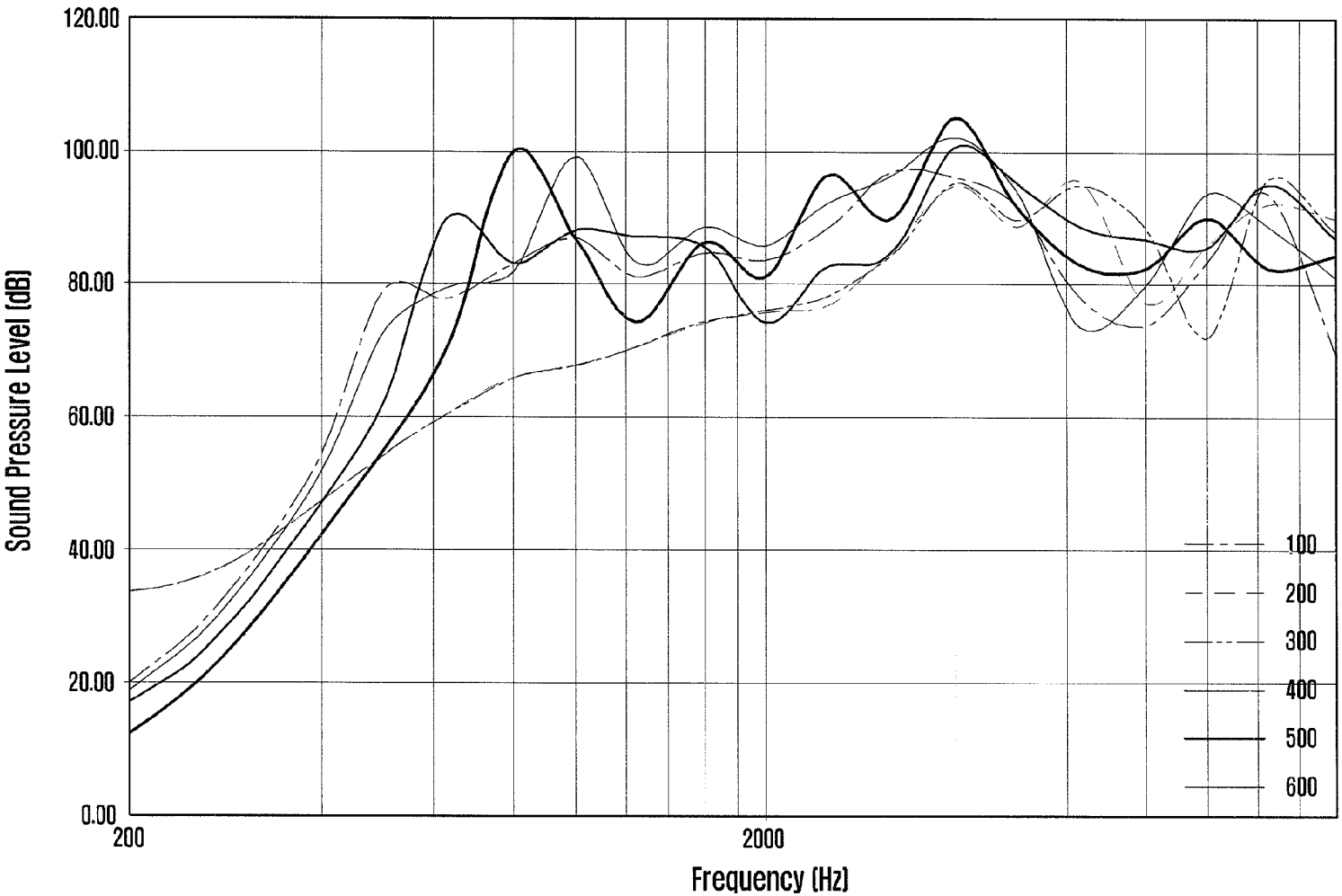
FIG. 12 is a chart illustrating distribution of sound pressure levels with respect to frequency in docking stations according to an exemplary embodiment of the present invention.
Figure 13:
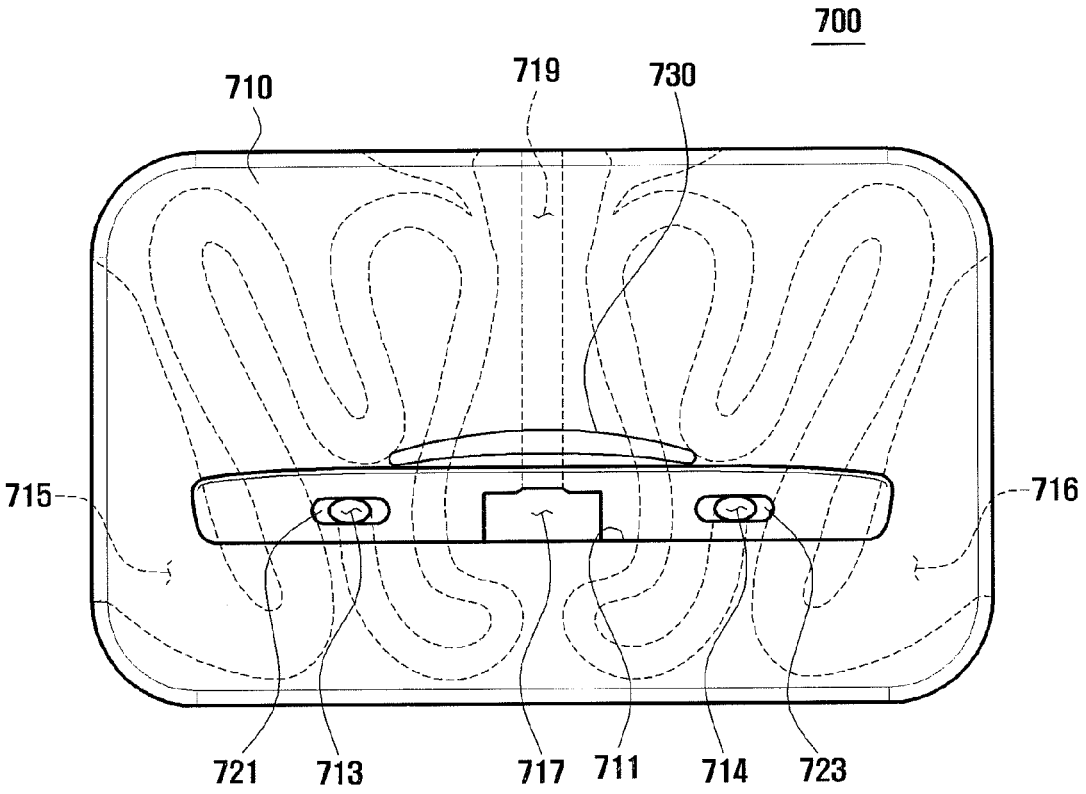
FIGS. 13 through 16 are transparent top views of docking stations according to exemplary embodiments of the present invention.
Figure 14:
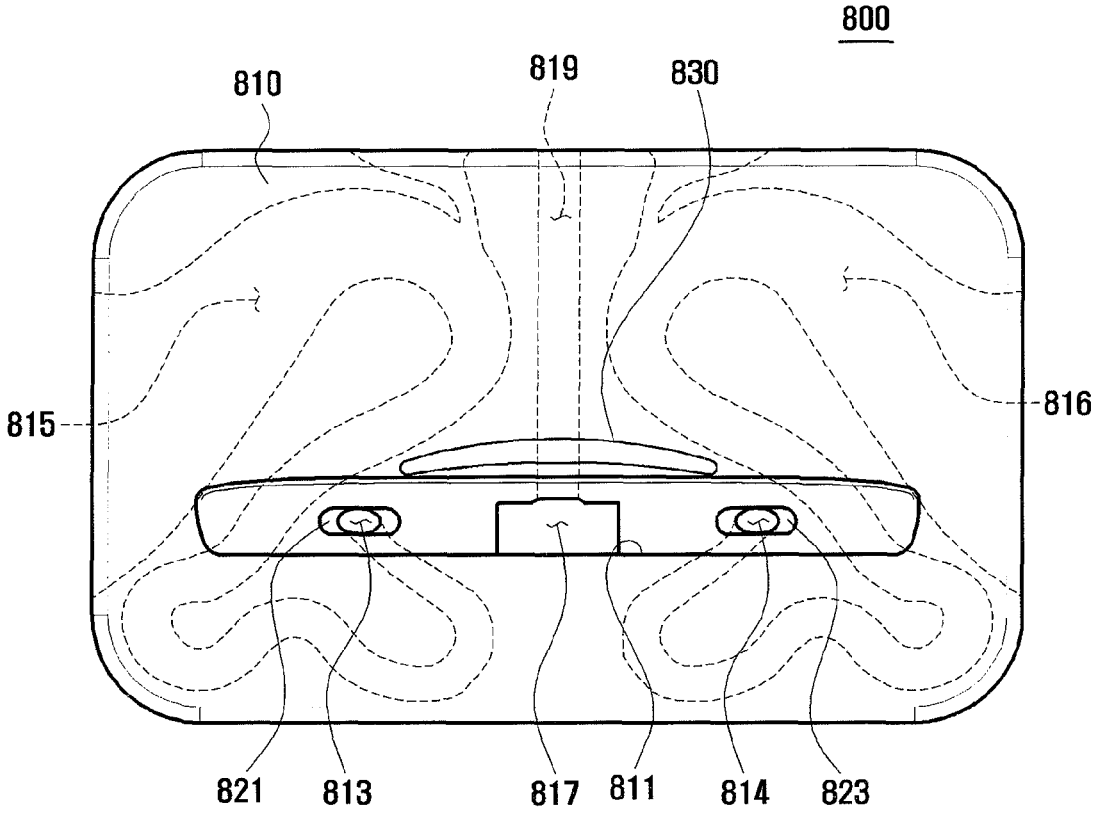
Figure 15:
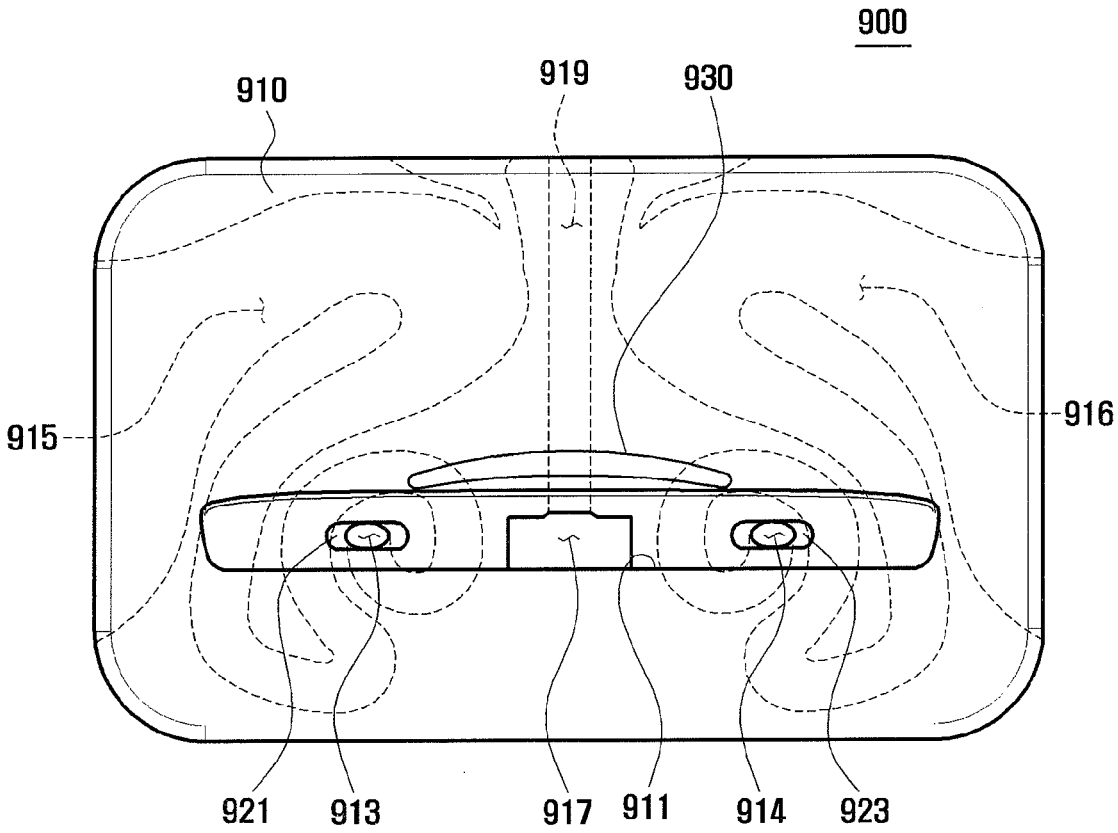
Figure 16:
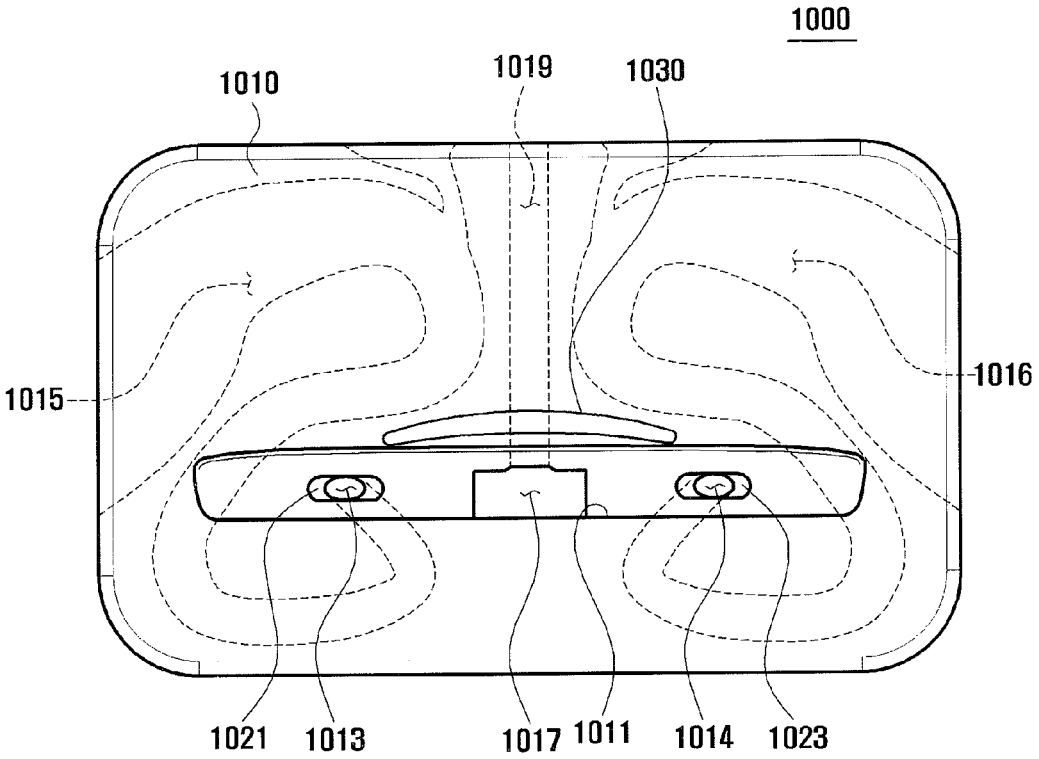

FIG. 12 is a chart illustrating distribution of sound pressure levels with respect to frequency in docking stations according to an exemplary embodiment of the present invention.

Referring to FIG. 12, when a mobile terminal outputs audible sound to the docking stations 100, 200, 300, 400, 500 and 600, the amount of change in sound pressure at peaks (reversal from increment to decrement) and dips (reversal from decrement to increment) is kept uniform within a given range. That is, in the docking stations 100, 200, 300, 400, 500 and 600, as the sound pressure relative to frequencies is maintained uniform, the amount of increase in sound volume is kept uniform. Hence, sound balance is sustained. The docking stations 100, 200, 300, 400, 500 and 600 may exhibit their highest operating efficiency at different frequency bands. In other words, the docking stations 100, 200, 300, 400, 500 and 600 may have their best sound balance at different frequency bands.

In an exemplary embodiment of the present invention, the configuration of the guide hole may be varied further. This is described in connection with FIGS. 13 through 16.

FIGS. 13 through 16 are transparent top views of docking stations according to exemplary embodiments of the present invention.

Referring to FIGS. 13 through 16, a docking station 700 includes a body 710, contact pads 721 and 723, and a support structure 730. A docking station 800 of FIG. 14 includes a body 810, contact pads 821 and 823, and a support structure 830. A docking station 900 of FIG. 15 includes a body 910, contact pads 921 and 923, and a support structure 930. A docking station 1000 of FIG. 16 includes a body 1010, contact pads 1021 and 1023, and a support structure 1030. The body 710 is configured to include a seating groove 711, two collecting holes 713 and 714, two guide holes 715 and 716, a connection hole 717, and a connection groove 719. The body 810 is configured to include a seating groove 811, two collecting holes 813 and 814, two guide holes 815 and 816, a connection hole 817, and a connection groove 819. The body 910 is configured to include a seating groove 911, two collecting holes 913 and 914, two guide holes 915 and 916, a connection hole 917, and a connection groove 919. The body 1010 is configured to include a seating groove 1011, two collecting holes 1013 and 1014, two guide holes 1015 and 1016, a connection hole 1017, and a connection groove 1019. Basically, each of the docking stations 700, 800, 900 and 1000 has a configuration similar to that of the docking station 100, and a detailed description thereof is omitted.

In each of the docking stations 700, 800, 900 and 1000, the guide holes extend from the corresponding collecting holes through the inside of the body to the outside along extension directions, respectively, the guide holes have a symmetrical structure (that is, the guide holes extend to the same length), and the guide holes are separately formed in two portions of the body.

In each of the docking stations 700, 800, 900 and 1000, the guide holes are formed to have a curved cross section perpendicular to the extension directions (that is, the cross section of the guide holes has a curved circumference like a circle or an ellipse), and each of the guide holes is formed to have a horn shape whose cross section increases along the extension direction. Hence, in each of the docking stations 700, 800, 900 and 1000, as the guide holes guide sound waves from the collecting holes to the outside, the volume of sound is gradually increased along the extension direction.

In each of the docking stations 700, 800, 900 and 1000, each of the guide holes is divided into two parts within the inside of the body. In other words, when the guide holes guide sound waves from the corresponding collecting holes to the outside, each outputs sound along two paths. Here, sounds are guided to the side and rear surfaces of the body and output.

The operating characteristics of each of the docking station 100, 200, 300, 400, 500, 600, 700, 800, 900 and 1000 are determined by the extension length of the guide hole and the rate of increase in the cross-sectional area of the guide hole along the extension direction. The amount of increase in sound volume with respect to frequency within the range of hearing is determined accordingly. Each of the docking station 100, 200, 300, 400, 500, 600, 700, 800, 900 and 1000 may maintain sound balance in the determined range of frequencies.

In the exemplary embodiments described above, the sound volume is increased by vibrations of the air in the guide holes. However, exemplary embodiments of the present invention are not limited thereto.

Figure 17:
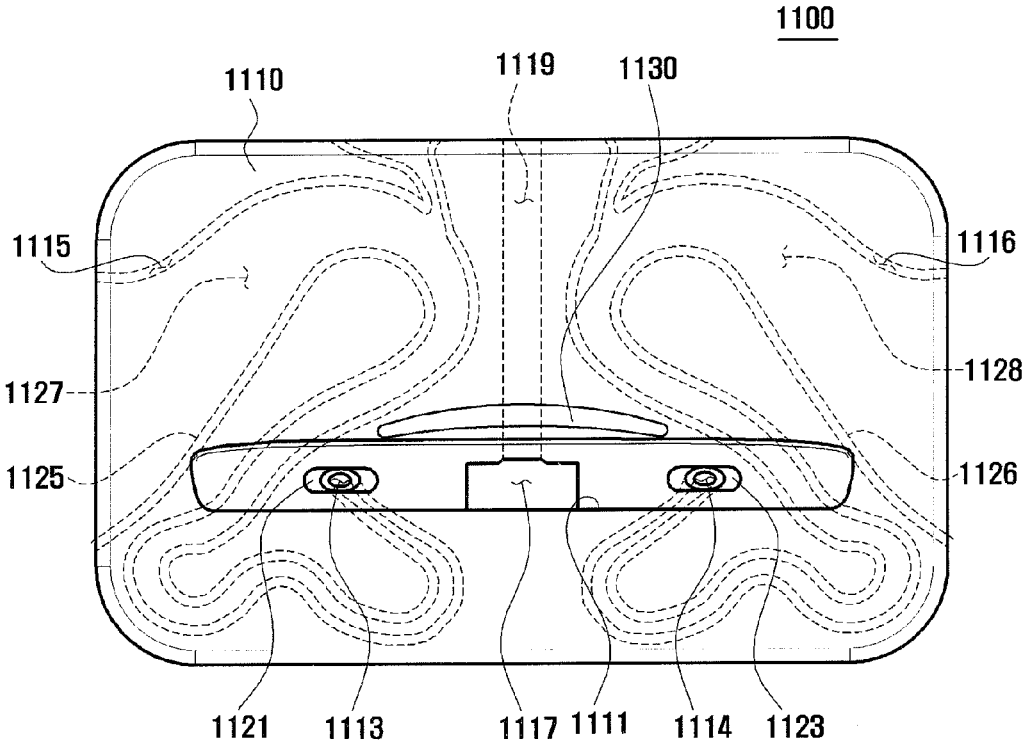
FIG. 17 is a transparent top view of a docking station according to an exemplary embodiment of the present invention.

FIG. 17 is a transparent top view of a docking station according to an exemplary embodiment of the present invention. In the following description, a docking station 1100 is assumed to have guide holes similar to those of the docking station 100.

Referring to FIG. 17, a docking station 1100 includes a body 1110, contact pads 1121 and 1123, and a support structure 1130. The body 1110 is configured to include a seating groove 1111, two collecting holes 1113 and 1114, two guide holes 1115 and 1116, a connection hole 1117, and a connection groove 1119. Basically, the docking station 1100 has a configuration similar to that of the other docking station described above. More particularly, the docking station 1100 further includes guide pipes 1125 and 1126.

The guide pipes 1125 and 1126 are inserted in the guide holes 1115 and 1116 so as to extend from the collecting holes 1113 and 1114 to the inside of the body 1110, respectively. The guide pipes 1125 and 1126 are configured to internally have vibration holes 1127 and 1128, respectively. The guide pipes 1125 and 1126 may be made of a material identical to or different from that of the body 1110. The guide pipes 1125 and 1126 may be made of metal, such as brass. The guide pipes 1125 and 1126 are filled with air. When the collecting holes 1113 and 1114 collect audible sound from the speakers 11 and 12 of the mobile terminal 10, the vibration holes 1127 and 1128 of the guide pipes 1125 and 1126 guide the audible sound from the collecting holes 1113 and 1114 to the outside. That is, sound propagates through vibration of the air in the vibration holes 1127 and 1128.

Each of the guide pipes 1125 and 1126 and the vibration holes 1127 and 1128 is formed to have a curved cross section perpendicular to the extension direction. That is, the cross section of the guide pipes 1125 and 1126 and the vibration holes 1127 and 1128 has a curved circumference like a circle or an ellipse. Hence, the guide pipes 1125 and 1126 may smoothly guide sound waves from the collecting holes 1113 and 1114, respectively, through the vibration holes 1127 and 1128 to the outside along the extension directions in a vortex-free manner. Each of the guide holes 1115 and 1116 is formed to have a horn shape where the cross section of each of the vibration holes 1127 and 1128 increases along the extension direction. Hence, as the guide pipes 1125 and 1126 guide sound waves through the vibration holes 1127 and 1128 to the outside, the volume of sound is gradually increased along the extension direction.

The guide pipes 1125 and 1126 are separated from the inner walls of the corresponding guide holes 1115 and 1116 so as not to contact with the inner walls. The two ends of the guide pipe are joined to the corresponding ends of the guide hole and fixed at the body 1110. Hence, when the guide pipes 1125 and 1126 guide sound waves through the vibration holes 1127 and 1128 to the outside, the guide holes 1115 and 1116 of the guide pipes 1125 and 1126 vibrate freely separately from the guide holes 1115 and 1116. That is, in the docking station 1100, the guide pipes 1125 and 1126 act like a wind instrument.

In addition, each guide pipe is divided into two branches along the corresponding guide hole in the inside of the body 1100. When the guide pipes 1125 and 1126 guide sound waves from the collecting holes 1113 and 1114 through the vibration holes 1127 and 1128 to the outside, each outputs sound through two paths. Hence, sound balance is maintained within the vibration holes 1127 and 1128 of the guide pipes 1125 and 1126. That is, in the vibration holes 1127 and 1128 of the guide pipes 1125 and 1126, the amount of increase in sound volume with respect to frequency within the range of hearing is kept uniform within a given range.

In the above exemplary embodiments, the body of the docking station is configured as a single entity. However, exemplary embodiments of the present invention are not limited thereto. A case in which the body is configured as two separable entities is described in connection with FIGS. 18 and 19.

Figure 18:
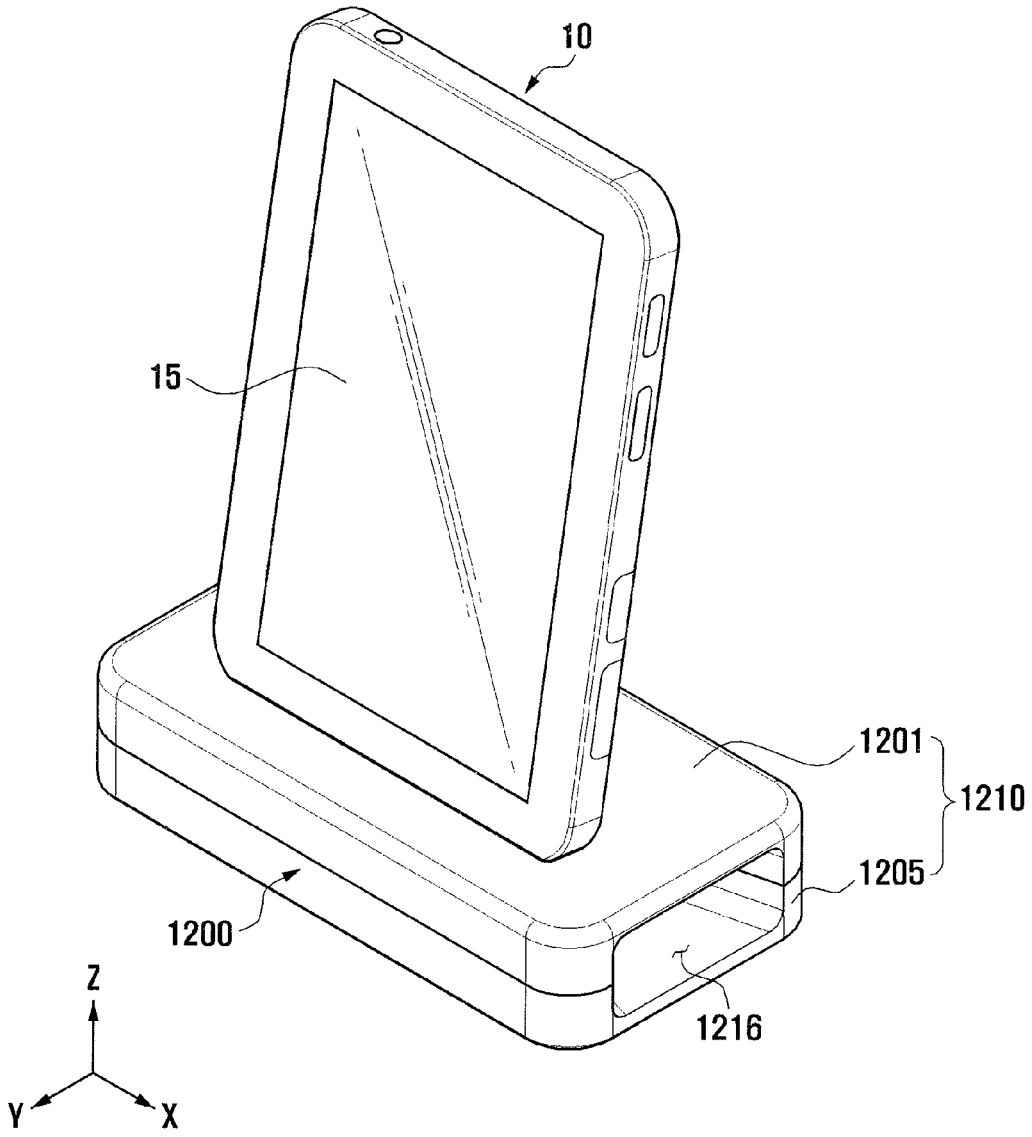
FIG. 18 is a top perspective view of a docking station according to an exemplary embodiment of the present invention.
Figure 19:
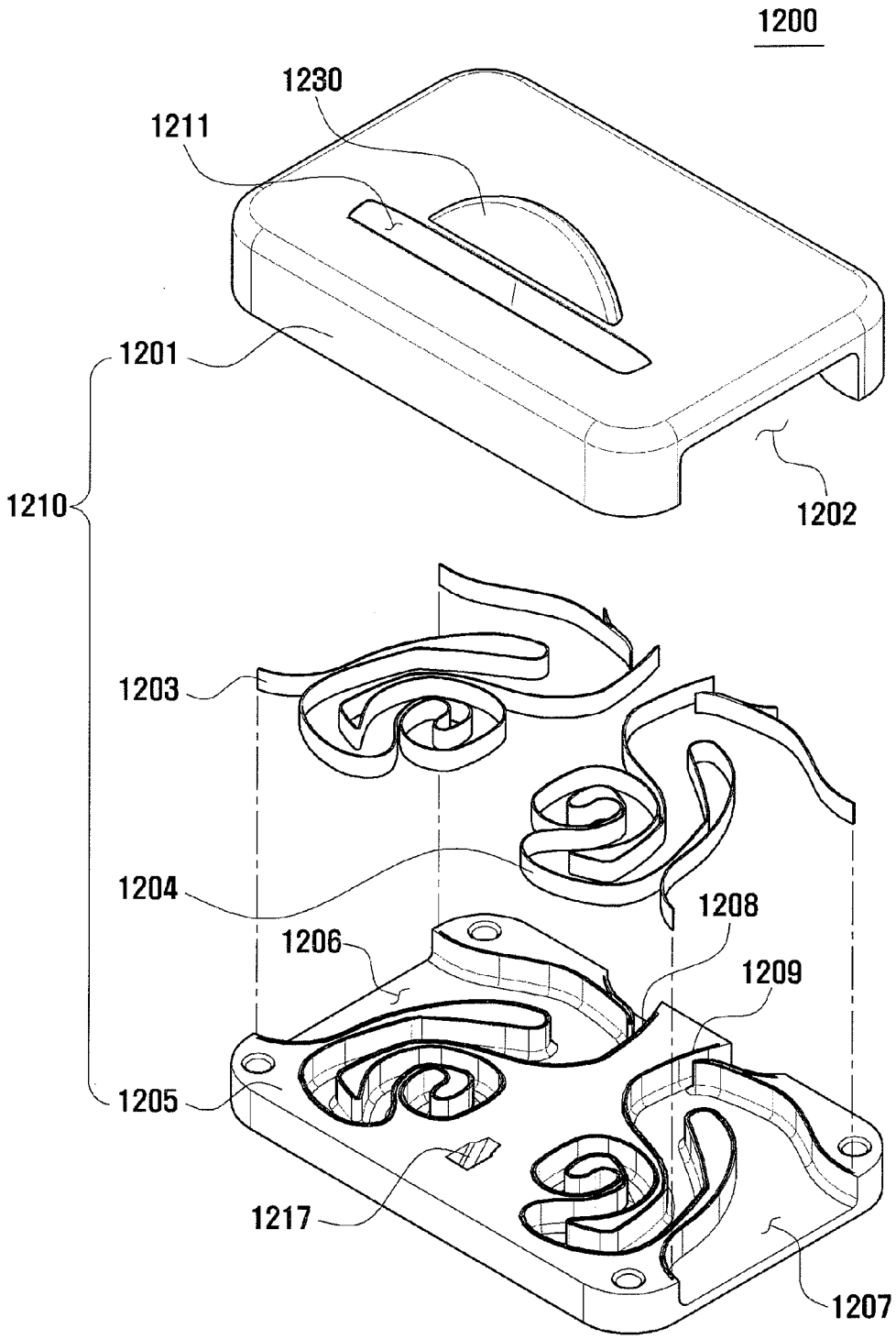
FIG. 19 is an exploded perspective view of a docking station according to an exemplary embodiment of the present invention.

FIGS. 18 and 19 illustrate a docking station according to exemplary embodiments of the present invention. FIG. 18 is a top perspective view of a docking station according to an exemplary embodiment of the present invention, and FIG. 19 is an exploded perspective view of a docking station according to an exemplary embodiment of the present invention.

Referring to FIGS. 18 and 19, a docking station 1200 is configured to be capable of being physically coupled to a mobile terminal 10. In the docking station 1200, the front is arranged to face in the same direction as display unit 15 of the mobile terminal 10, and the sides are arranged to connect the front and the rear. The docking station 1200 includes a body 1210, contact pads (not shown), and a supporting part 1230. The docking station 1200 has a configuration similar to that of the docking station 100, and a detailed description thereof is omitted. However, the docking station 1200 is realized as combinable units.

The body 1210 of the docking station 1200 provides a supplementary function to the mobile terminal 10. The body 1210 has a preset shape and size. For example, the body 1210 may take the form of a hexahedron having a fixed area, thickness and rounded edges. The body 1210 may be made of plastic and includes an upper body 1201, two sealing members 1203 and 1204, and a lower body 1205. The upper body 1201 and the lower body 1205 are combined together via the sealing members 1203 and 1204.

The upper body 1201 is configured to include a seating groove 1211, two collecting holes (not shown), two upper guide grooves 1202, two upper sealing grooves (not shown), and an upper connection hole (not shown).

The seating groove 1211 is formed so as to extend from the upper surface of the upper body 1201 to the inside thereof and has a given depth. To accommodate the bottom side 17 of the mobile terminal 10, the seating groove 1211 is formed to be wider than the bottom side 17.

Each of the collecting holes extends from the upper surface of the upper body 1201 to the lower surface thereof through the upper body 1201. On the upper surface of the upper body 1201, the collecting holes are separated by a distance equal to the distance between the speakers 11 and 12 of the mobile terminal 10. The collecting holes are formed within the seating groove 1211. When the bottom side 17 of the mobile terminal 10 is seated on the upper surface of the upper body 1201, the collecting holes physically contact the speakers 11 and 12, respectively. When the mobile terminal 10 outputs audible sound through the speakers 11 and 12, the collecting holes collect the audible sound from the speakers 11 and 12.

The upper guide grooves 1202 are formed so as to be connected to the collecting holes, respectively, and extend toward the inside at a given depth across the lower surface of the upper body 1201. The upper guide grooves 1202 extend from the collecting holes to the outside along extension directions on the lower surface of the upper body 1201. The upper guide grooves 1202 have a symmetrical structure. That is, the upper guide grooves 1202 extend to the same length. The upper guide grooves 1202 are separately formed in two portions of the upper body 1201. Each of the upper guide grooves 1202 is formed to have a cross-section like a semicircle perpendicular to the extension direction. That is, the upper guide grooves 1202 have a curved cross-section.

The upper sealing grooves are formed along the upper guide grooves 1202 on the lower surface of the upper body 1201. The upper sealing grooves are arranged close to the corresponding upper guide grooves 1202. Moreover, the upper sealing grooves are formed so as to extend toward the inside at a given depth across the lower surface of the upper body 1201. The upper sealing grooves are separately formed in two portions of the upper body 1201 and extend separately from and alongside the corresponding upper guide grooves 1202. The upper sealing grooves have a symmetrical structure where they extend to the same length.

The upper connection hole extends to penetrate the upper body 1201 from the upper surface to the lower surface. In the upper body 1201, the upper connection hole is extended between the collecting holes and between the upper guide grooves 1202 and is separated from the collecting holes and the upper guide grooves 1202. The upper connection hole is separated by a given distance from the collecting holes on the upper surface of the upper body 1201, and the distance from the upper connection hole to the collecting holes is equal to the distance from the connecting socket 13 to the speakers 11 and 12. The upper connection hole is formed within the seating groove 1211. Hence, when the bottom side 17 of the mobile terminal 10 is placed on the upper surface of the upper body 1201, the upper connection hole physically contacts the connecting socket 13.

The sealing members 1203 and 1204 are inserted in the upper sealing grooves, respectively, on the lower surface of the upper body 1201 so as to protrude forwards. The sealing members 1203 and 1204 may be made of rubber, silicone or a synthetic polymer and have a symmetrical structure where they extend to the same length. The sealing members 1203 and 1204 are separately formed in two portions of the upper body 1201. That is, the sealing members 1203 and 1204 are formed in the same configuration as the corresponding upper sealing grooves.

The lower body 1205 is configured to include two lower guide grooves 1206 and 1207, two lower sealing grooves 1208 and 1209, a lower connection hole 1217, and a connection groove (not shown).

The lower guide grooves 1206 and 1207 are formed so as to extend toward the inside at a given depth across the upper surface of the lower body 1205. The lower guide grooves 1206 and 1207 extend from the central regions to the outside along extension directions on the upper surface of the lower body 1205. The lower guide grooves 1206 and 1207 have a symmetrical structure where they extend to the same length. The lower guide grooves 1206 and 1207 are separately formed in two portions of the lower body 1205. Each of the lower guide grooves 1206 and 1207 is formed to have a cross-section like a semicircle perpendicular to the extension direction. That is, the lower guide grooves 1206 and 1207 have a curved-cross section.

The lower sealing grooves 1208 and 1209 are formed along the lower guide grooves 1206 and 1207 on the upper surface of the lower body 1205. The lower sealing grooves 1208 and 1209 are arranged close to the corresponding lower guide grooves 1206 and 1207, respectively. The sealing members 1203 and 1204 are inserted in the lower sealing grooves 1208 and 1209, respectively, on the upper surface of the lower body 1205 so as to protrude forwards. The lower sealing grooves 1208 and 1209 are formed in the same configuration as the corresponding sealing members 1203 and 1204, respectively. The lower sealing grooves 1208 and 1209 are formed so as to extend toward the inside at a given depth across the upper surface of the lower body 1205. The lower sealing grooves 1208 and 1209 extend separately from and alongside the corresponding lower guide grooves 1206 and 1207, respectively. The lower sealing grooves 1208 and 1209 have a symmetrical structure where they extend to the same length. The lower sealing grooves 1208 and 1209 are separately formed in two portions of the lower body 1205.

The lower connection hole 1217 extends to penetrate the lower body 1205 from the upper surface to the lower surface. In the lower body 1205, the lower connection hole 1217 is extended between the lower guide grooves 1206 and 1207 and is separated therefrom.

The connection groove extends from the lower surface of the lower body 1205 to the inside thereof, and is formed to run through the lower surface of the lower body 1205 to a given depth. The connection groove extends from the lower connection hole 1217 to one side of the lower body 1205. To accommodate the cable 20, the connection groove is formed to be thicker than the cable 20.

The sealing members 1203 and 1204 are inserted in the corresponding upper sealing grooves on the lower surface of the upper body 1201 so as to protrude forwards. The sealing members 1203 and 1204 are inserted in the corresponding lower sealing grooves 1208 and 1209, respectively, on the upper surface of the lower body 1205 so as to protrude forwards. In other words, the upper sealing grooves of the upper body 1201 accommodate portions of the sealing members 1203 and 1204, respectively, and the lower sealing grooves 1208 and 1209 of the lower body 1205 accommodate the remaining portions of the sealing members 1203 and 1204, respectively. Hence, the upper body 1201 and the lower body 1205 are combined together via the sealing members 1203 and 1204 to form the body 1210.

When the lower surface of the upper body 1201 is brought into contact with the upper surface of the lower body 1205, the upper guide grooves 1202 are coupled with the lower guide grooves 1206 and 1207 to form two guide holes 1216. Hence, the guide holes 1216 extend from the collecting holes through the inside of the body 1210 and to the outside along extension directions. The guide holes 1216 have a symmetrical structure where they extend to the same length. The guide holes 1216 are separately formed in two portions of the body 1210. The sealing members 1203 and 1204 seal the guide holes 1216 at the interface between the lower surface of the upper body 1201 and the upper surface of the lower body 1205, and the guide holes 1216 are filled with air. Hence, when the collecting holes collect audible sound from the speakers 11 and 12 of the mobile terminal 10, the guide holes

1216 guide the audible sound from the collecting holes to the outside. That is, sound is propagated through vibration of air in the guide holes 1216. The sealing members 1203 and 1204 tightly seal the guide holes 1216 and prevent sound from leaking from the guide holes 1216 to the outside.

Each of the guide holes 1216 is formed to have a curved cross-section perpendicular to the extension direction. That is, the cross-section of the guide holes 1216 has a curved circumference like a circle or an ellipse. Hence, the guide holes 1216 may smoothly guide sound from the collecting holes to the outside along the extension directions in a vortex-free manner. Each of the guide holes 1216 is formed to have a configuration whose cross-section increases along the extension direction. Consequently, as the guide holes 1216 guide sound waves from the collecting holes to the outside, the volume of the sound gradually increases along the extension direction.

Each of the guide holes 1216 is divided into two branches within the inside of the body 1210. In other words, when the guide holes 1216 guide sound waves from the collecting holes to the outside, each of the guide holes 1216 outputs sound through two paths leading to the side surface and the rear surface of the body 1210. Hence, the guide holes 1216 help to maintain sound balance. That is, in the guide holes 1216, the amount of increase in sound volume is uniformly maintained within a given range along frequencies within the range of hearing.

When the lower surface of the upper body 1201 is brought into contact with the upper surface of the lower body 1205, the upper connection hole and the lower connection hole are joined together to form a connection hole 1217. Hence, the connection hole 1217 extends to penetrate the body 1210 from the upper surface of the upper body 1201 to the lower surface of the lower body 1205. When a cable 20 connected to an external device (not shown) is inserted from the lower surface of the body 1210, the connection hole 1217 supports connection between the connecting socket 13 and the cable 20. In this case, the external device may correspond to an external power source charging the mobile terminal 10 or to a wired communication device communicating with the mobile terminal 10.

In the above description, the upper body 1201 and the lower body 1205 are combined together via sealing members. Alternatively, the upper body 1201 and the lower body 1205 may be directly bonded together without the use of sealing members. For example, by applying an adhesive to at least one of the lower surface of the upper body 1201 and the upper surface of the lower body 1205, the upper body 1201 may be combined with the lower body 1205. In this case, at least one of the upper sealing grooves of the upper body 1201 and the lower sealing grooves 1208 and 1209 of the lower body 1205 may not be formed.

In the above exemplary embodiments, docking stations are described as having two collecting holes and two guide holes. However, exemplary embodiments of the present invention are not limited thereto. For example, an exemplary embodiment of the present invention may be applied to a docking station having one collecting hole and two guide holes. In this case, the two guide holes may be configured to extend from the single collecting hole. Exemplary embodiments of the present invention may also be applied to a docking station having one collecting hole and one guide hole or to a docking station having at least three collecting holes and at least three guide holes.

As is apparent from the above description, an exemplary docking station of the present invention increases the volume of audible sound coming from a mobile terminal without distortion through a guide hole. The docking station does not require electrical connection to the mobile terminal and does not have to be connected to an external power source. That is, the docking station is capable of increasing the volume of audible sound without separate supply of power. In addition, the docking station guides sound waves along multiple paths through the guide hole and hence may maintain sound balance. The amount of increase in sound volume with respect to frequency within the range of hearing is kept uniform within a given range, and sound quality is improved. As a result, the docking station may output sounds pleasant to the user, and the usefulness of the docking station is increased.

While the invention has been shown and described with reference to certain exemplary embodiments thereof, it will be understood by those skilled in the art that various changes in form and details may be made therein without departing from the spirit and scope of the invention as defined in the appended claims and their equivalents.

What is claimed is:

1. A docking station comprising:

a support structure for holding an electronic device having a first internal speaker to sustain the posture of the electronic device; and a body for supporting the support structure, and for physically contacting a bottom surface of the electronic device placed on an upper surface of the body, wherein the body comprises:

a collecting hole for contacting the first internal speaker of the electronic device to collect sound waves, and a guide hole that extends from the collecting hole through an inside of the body to an outside of the body, wherein the guide hole has at least two branches within the inside of the body to guide the collected sound waves along different paths that extend to at least one side surface of the body and has a pre-designed shape.

2. The docking station of claim 1, wherein the body further comprises a second guide hole having a structure symmetrical with that of the guide hole.

3. The docking station of claim 2, wherein the body further comprises a second collecting hole that physically contacts a second internal speaker of the electronic device to collect sounds output by the second internal speaker and is connected with the second guide hole.

4. The docking station of claim 1, wherein the guide hole is configured to be divided into at least two branches and combined into one within the body.

5. The docking station of claim 1, wherein the body further comprises a guide pipe that is inserted in the guide hole and extended along the extension direction, and contains a vibration hole having a horn shape whose cross section increases along the extension direction to guide collected sounds along the extension direction within the guide hole.

6. The docking station of claim 1, wherein, in the guide hole, the amount of increase in sound volume with respect to frequency within a range of hearing is kept uniform within a given range.

7. The docking station of claim 1, wherein the support structure comprises:

a rotating part that contains a receiving hole to expose the collecting hole to the outside and to securely accommodate the electronic device, is rotatably coupled to the body, and changes, when the electronic device is placed thereon, the posture of the electronic device through rotation relative to the body; and a fixing part that stops rotation of the rotating part to fix the rotating part to the body, and fixes, when the electronic device is placed thereon, the posture of the electronic device.

8. The docking station of claim 1, further comprising a contact pad that is placed between the first internal speaker and a zone around the collecting hole to tightly contact the first internal speaker and the collecting hole.

9. The docking station of claim 8, wherein the contact pad is made of at least one of rubber, silicone and synthetic polymer to prevent leakage of sounds from the first internal speaker.

10. The docking station of claim 1, wherein the body comprises:

an upper body having an upper guide groove that extends from the collecting hole via a central region to the outside along the extension direction on a lower surface thereof; and a lower body coupled with the upper body, and having a lower guide groove, which forms the guide hole when combined with the upper guide groove, on an upper surface thereof.

11. The docking station of claim 10, wherein the body further comprises a sealing member inserted in both the upper body and the lower body and combines a region around the upper guide groove with a region around the lower guide groove to seal the guide hole.

12. The docking station of claim 10, wherein the upper body and the lower body are coupled together using an adhesive applied to at least one of the lower surface of the upper body and the upper surface of the lower body.

13. The docking station of claim 1, wherein the guide hole has a horn shape whose cross section increases along an extension direction.

* * * * *